US006425154B1

(12) United States Patent
O'Connell

(10) Patent No.: US 6,425,154 B1
(45) Date of Patent: Jul. 30, 2002

(54) SELF-ASSISTED TRANSFER SYSTEM FOR BEDS

(76) Inventor: Timothy B. O'Connell, 6501 Underwood Cove, Fort Wayne, IN (US) 46835

( * ) Notice: Subject to any disclaimer, the term of this patent is extended or adjusted under 35 U.S.C. 154(b) by 0 days.

(21) Appl. No.: 09/517,730

(22) Filed: Mar. 2, 2000

(51) Int. Cl.[7] ..... A47C 21/00; A61G 7/10

(52) U.S. Cl. ..... 5/662; 5/81.1 R; 5/83.1; 482/904; 482/121

(58) Field of Search ..... 5/662, 81.1 R, 5/658, 83.1; 482/904, 121

(56) References Cited

U.S. PATENT DOCUMENTS

| | | | | | |
|---|---|---|---|---|---|
| 798,114 | A | * | 8/1905 | Rosenthal | 5/662 |
| 1,341,483 | A | * | 5/1920 | Slocum | 5/507.1 |
| 3,176,322 | A | | 4/1965 | Mulcahy | |
| 3,739,793 | A | | 6/1973 | Wilson | 135/45 |
| 4,253,207 | A | | 3/1981 | Marcyan | 5/84 |
| 4,679,265 | A | | 7/1987 | Wicks | 5/445 |
| 4,686,727 | A | | 8/1987 | Wilkinson | 5/503 |
| 4,932,090 | A | | 6/1990 | Johansson | 5/445 |
| 5,195,200 | A | | 3/1993 | Leoutsakos | 5/662 |
| 5,231,721 | A | | 8/1993 | Fish | 5/662 |
| 5,257,426 | A | | 11/1993 | Leoutsakos | 5/503.1 |
| 5,335,385 | A | | 8/1994 | Brown | 5/662 |
| 5,400,450 | A | | 3/1995 | Leoutsakos | 5/662 |
| 5,471,689 | A | | 12/1995 | Shaw et al. | 5/662 |
| 5,787,530 | A | | 8/1998 | Brix | 5/662 |
| 6,163,906 | A | * | 12/2000 | Kay | 5/662 |

FOREIGN PATENT DOCUMENTS

| | | | | |
|---|---|---|---|---|
| CH | 58088 | * | 9/1911 | 5/662 |

OTHER PUBLICATIONS

Sears Home Health Care 1999–2000 Catalog, p. 55 date Jun. 1999 (?).

* cited by examiner

*Primary Examiner*—Alexander Grosz
(74) *Attorney, Agent, or Firm*—Paul W. O'Malley; Susan L. Firestone

(57) ABSTRACT

A patient self-assist transfer aid provides an open box frame having a base for fitting beneath a mattress of a bed, a riser section extending upwardly from the base for extending around an edge of the mattress and a positioning section for extending out over the mattress from the riser section. The open box frame may be positioned around the mattress end at the foot of the bed to leave the major sides of the bed open for ease of access. A linkage is fitted to the positioning section of the open box frame and may be extended therefrom to position a handle within easy grasp of a person laying in the bed. A spring system biases the linkage to a retracted position in the open box frame. A handle is pivotally attached to the linkage and for grasping by a patient recumbent in the bed or lowering him or herself into bed.

14 Claims, 3 Drawing Sheets

SELF-ASSISTED TRANSFER SYSTEM FOR BEDS

BACKGROUND OF THE INVENTION

1. Field of the Invention

The present invention relates to human mobility aids, and more particularly to an aid to be used by a person in moving from a fully reclined position in bed to a standing position adjacent the bed and back.

2. Description of the Art and Problem

Even a brief review of the art reveals numerous references which provide systems for helping patients get into and out of bed without caregiver assistance. Many of the references teach bed rail and handle systems, adapted by positioning and shaping, to give support to a person moving from a sitting position on a bed to a standing position adjacent the bed, or from a standing position back to a sitting position. Indeed, for many infirm individuals, moving from a sitting to a standing position is the greatest challenge and such devices are very useful for maintaining balance as they stand. However, the problems involved in getting into and out bed frequently involve more than moving from standing to sitting or from sitting to standing. Some references implicitly recognize that helping the patient stand up from, or sit down on, a bed or chair is just one part of the problem, for example U.S. Pat. No. 3,739,793 to Wilson.

Some conditions, such as Parkinson's disease, can contribute to a progressive degeneration of the abdominal muscles, which makes sitting up without assistance difficult or impossible. Temporary conditions, such as recovery from abdominal surgery can also leave the abdomen weak. Relatively few references deal with bed ingress and egress assistance devices which provide assistance to individuals in sitting up in bed. One reference that does teach such a device is U.S. Pat. No. 4,679,265 to Wicks. Wicks teaches a tether hooked to an anchoring member, which is provided by a U-shaped hook sized to be fitted around the foot of a bed mattress. Using the tether a person can help themselves sit up from a recumbent position by pulling themselves up on the tether. While the device is exceedingly simple and unobtrusive, it is unclear how the tether remains positioned for easy grasping by the bed occupant over the course of a night. Nor does the system do anything for individuals who have lost substantial upper body strength. A trapeze system is taught in U.S. Pat. No. 4,686,727 to Wilkinson, which provides assistance to patients in sitting up from bed. Another such system is that taught in U.S. Pat. No. 4,253,207 to Marcyan. In trapeze systems a bar or handle is suspended over the bed for grasping by the bed occupant.

A common theme among several references is ease of installation and portability, which is carried out in part by tubular construction of rail systems and extensions of the tubing to fit under and to be anchored by the bed's mattress. U.S. Pat. No. 5,471,689 to Shaw is a good example of a device incorporating these features.

SUMMARY OF THE INVENTION

An object of the invention is to provide an apparatus aiding the infirm in getting into and out of bed by helping the person move from a standing position adjacent the bed to a recumbent position on the bed and back.

Another object of the invention is to provide a patient mobility aid for use with beds which does not limit access to the bed.

It is a still further object of the invention to provide an aid for use with beds which is readily removed or placed in the bed.

According to the invention there is provided a patient self-assist transfer aid for use with a bed. The self-assist transfer aid comprises an open box frame having a base for fitting beneath a mattress of a bed, a riser section extending upwardly from the base around an outside edge of the mattress and a positioning section for extending out over the mattress from the riser section. The open box frame may be positioned around the mattress end at the foot of the bed to leave the major sides of the bed open for ease of access. A linkage is fitted to the positioning section of the open box frame and may be extended therefrom to position a handle within easy grasp of a person lying in the bed or laying down on the bed. A spring system biases the linkage to a retracted position in the open box frame. A handle is pivotally attached to the linkage and for grasping by a patient lying in the bed or lowering him or herself into bed.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
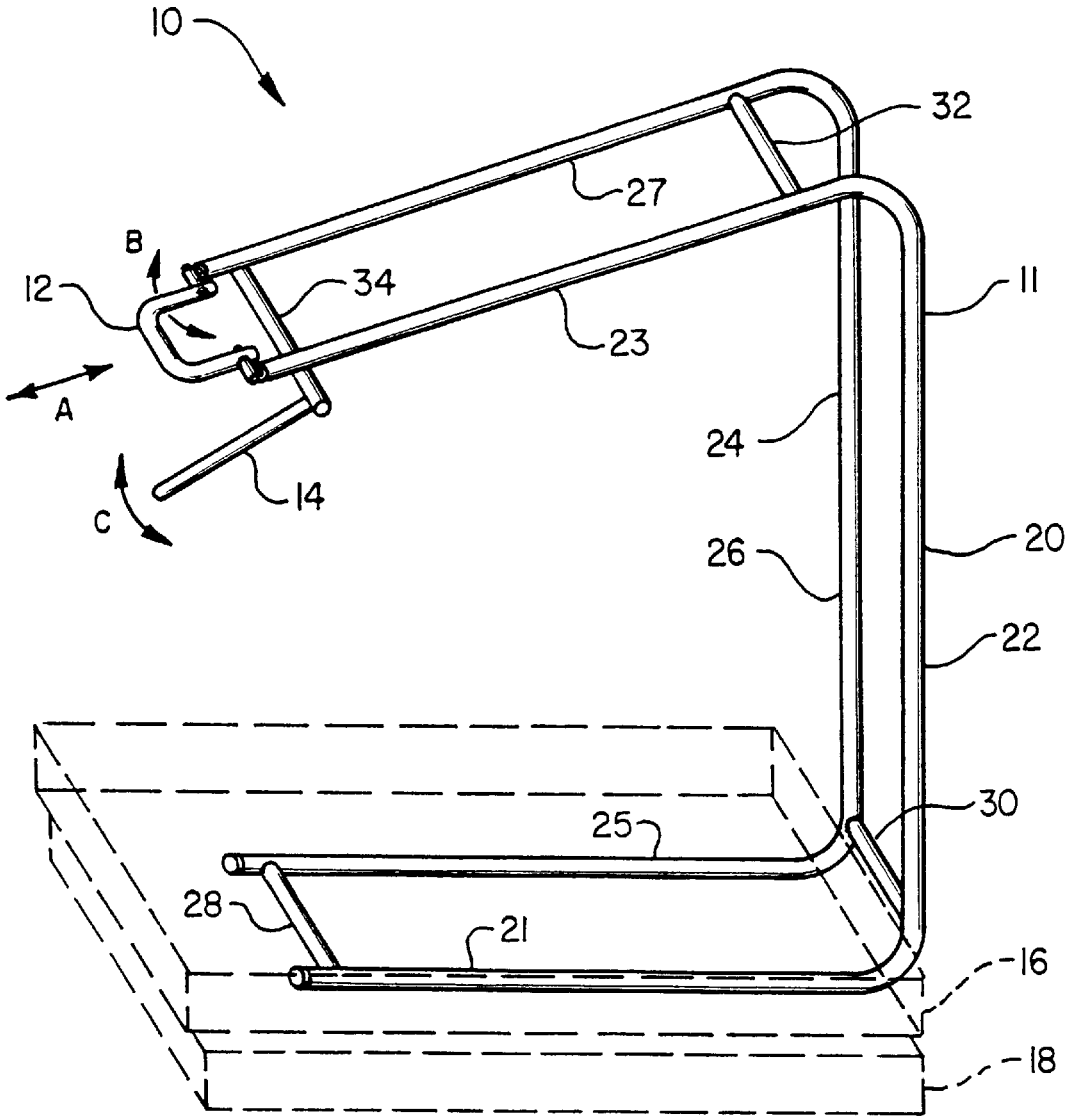
FIG. 1 is a perspective view of a preferred embodiment of the self-assist mobility aid of the invention.
Figure 2:
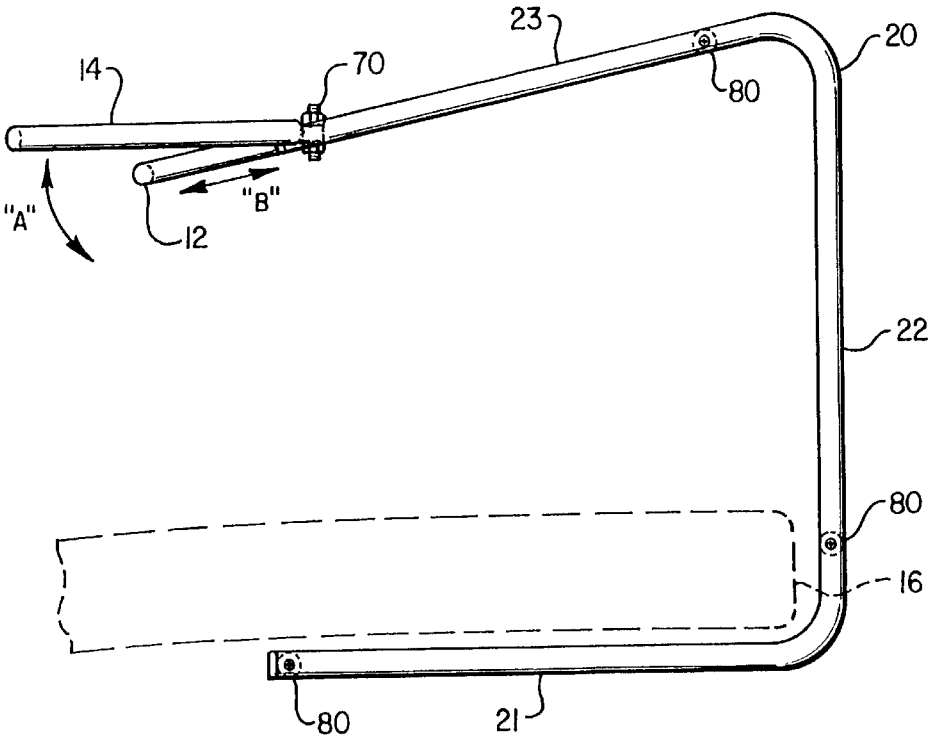
FIG. 2 is a side elevation view of the embodiment of FIG. 1.

Referring now to FIGS. 1 and 2, a preferred embodiment of the transfer aid 10 of the present invention is illustrated. Transfer aid 10 comprises a frame 11 which is shaped to provide a base which fits between a mattress 16 and a foundation 18 such as box springs or a bed platform. From its base the frame extends around an edge of the mattress 16, preferably the end of the mattress located at the foot of a bed. The opposite end of frame 11 is located over the mattress. On the end of frame 11 over mattress 16, a handle 12 and a support brace 14 are positioned for the use of a person getting into and out of bed.

The upper section of frame 11, defined in part by arms 23 and 27, slants downwardly from a location over the end of the mattress 16 toward the head of the bed. Handle 12 is movable on frame 11 from the end of the frame over the bed in the directions indicated by double arrow "A". Handle 12 thus may be extended somewhat downwardly toward the head of the bed and retracted back into frame 11. Handle 12 is spring loaded to urge the handle toward a retracted position within frame 11. Spring tension is preferably selected to provide almost all of the retractive force required to pull a recumbent individual to a sitting position. Thus a person can use handle 12 to gently lower themselves onto the bed from a sitting position and can, from a recumbent position, pull the handle towards themselves. Handle 12 is also rotatable in the directions indicated by double arrow "B" on an axis which is parallel to the upper major surface of mattress 16 to allow the handle to be pushed out of the way.

A support brace 14 is also mounted to a cross member 34 near the upper end of frame 11. Support brace 14 may be rotated in the directions indicated by double arrow "C" about an axis substantially perpendicular to the upper major surface of mattress 16. Brace 14 may be moved out over one of the major edges of mattress 16 to provide support to a person moving from a standing position along side the bed to a sitting position on mattress 16, or from a sitting position on the mattress to standing alongside the bed.

Frame 11 has three major sections, defined by their respective functions, which are as a base or foundation to support aid 10 in standing on one side of the frame, to position patient aid braces and handles within easy reach for use in moving from position to position, and to provide support to the positioning section from around an edge of a mattress for a bed. Frame 11 is constructed from two tubular members 20 and 24, and a plurality of transverse cross members 28, 30, 32 and 34. Each tubular member has, in turn, three major sections corresponding to the principal parts of the frame 11. For tubular member 20 there is a base leg 21, an upright 22 and a positioning arm 23. The tubular member 20 may be formed from a single tube with curved transition sections between the major sections. Similarly, tubular member 24 has a base leg 25, an upright 26 and a positioning arm 27. The base of frame 11 is defined by a base legs 21 and 25 and a lower cross member 28. The base is illustrated as positioned below a mattress 16, which stabilizes frame 11 on a box spring or platform 18.

Vertical support for arms 23 and 27 is provided by vertical uprights 20 and 24, respectively. Uprights 20 and 24 are braced against on one another be cross member 30. Positioning arms 23 and 27 are linked by cross members 32 and 34. Cross members 28, 30, 32 and 34 are attached to tubular members 20 and 24 by suitable fastening means. For cross members 28, 30 and 32 these may include penetration of the tubular members 20 and 24 by the ends of the cross members coupled with screws through the bodies of the tubular members into the cross members. Cross member 34 serves other functions and is attached to tubular members 20 and 24 somewhat differently as is described below. Frame 11 generally defines a U-shaped frame, which can be fitted around one edge of bed mattress and which is held in place by the mattress.

Specific construction elements, such as tubular frames, joints, bends and cross members, including consideration of their size and material may vary upon specific application of the device, for example in houses or health care facilities, or the type of bed used. Spring types, fasteners and the like may be chosen based on cost considerations or the desire for the highest refinement of the tool. The basic design concept would be unchanged. For example, hospital and nursing home beds are different than beds normally found in individual houses or apartments in that a spring grid is all that is provided immediately under the top level bedding element. No box spring is provided and as a result no integral surface exists as a base. In such an application a tubular frame base would not be appropriate. In some applications a welded joint in place of a solid bent joint, or rectangular tubing instead of circular cross-section tubing, may enhance rigidity. Exterior mounted adjustable gas springs could be substituted for internally mounted metal compression springs could be used.

FIG. 2 is a side elevation of frame 11 illustrating more fully tubular member 20 and the position and movement relative thereto of handle 12. Brace 14 swings on a pivot axis 70 which is perpendicular to the upper major surface of mattress 16. A plurality of screws 80 are set in tubular member 20 to hold cross members in place. Similar screws (not shown) join the cross members to tubular member 24.

Figure 4:
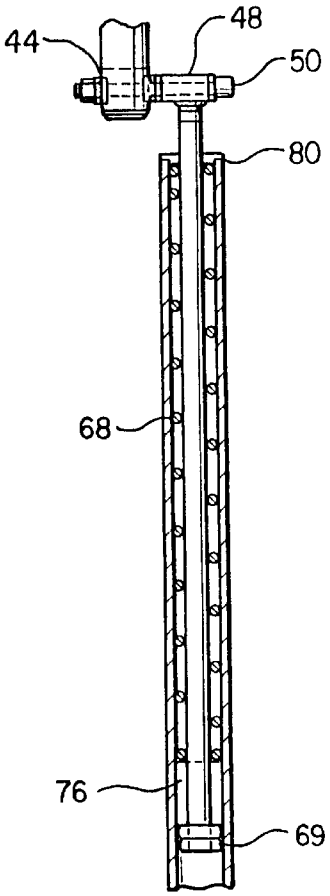
FIG. 4 is a cross sectional view of an extensible piston rod used in the first embodiment.
Figure 3:
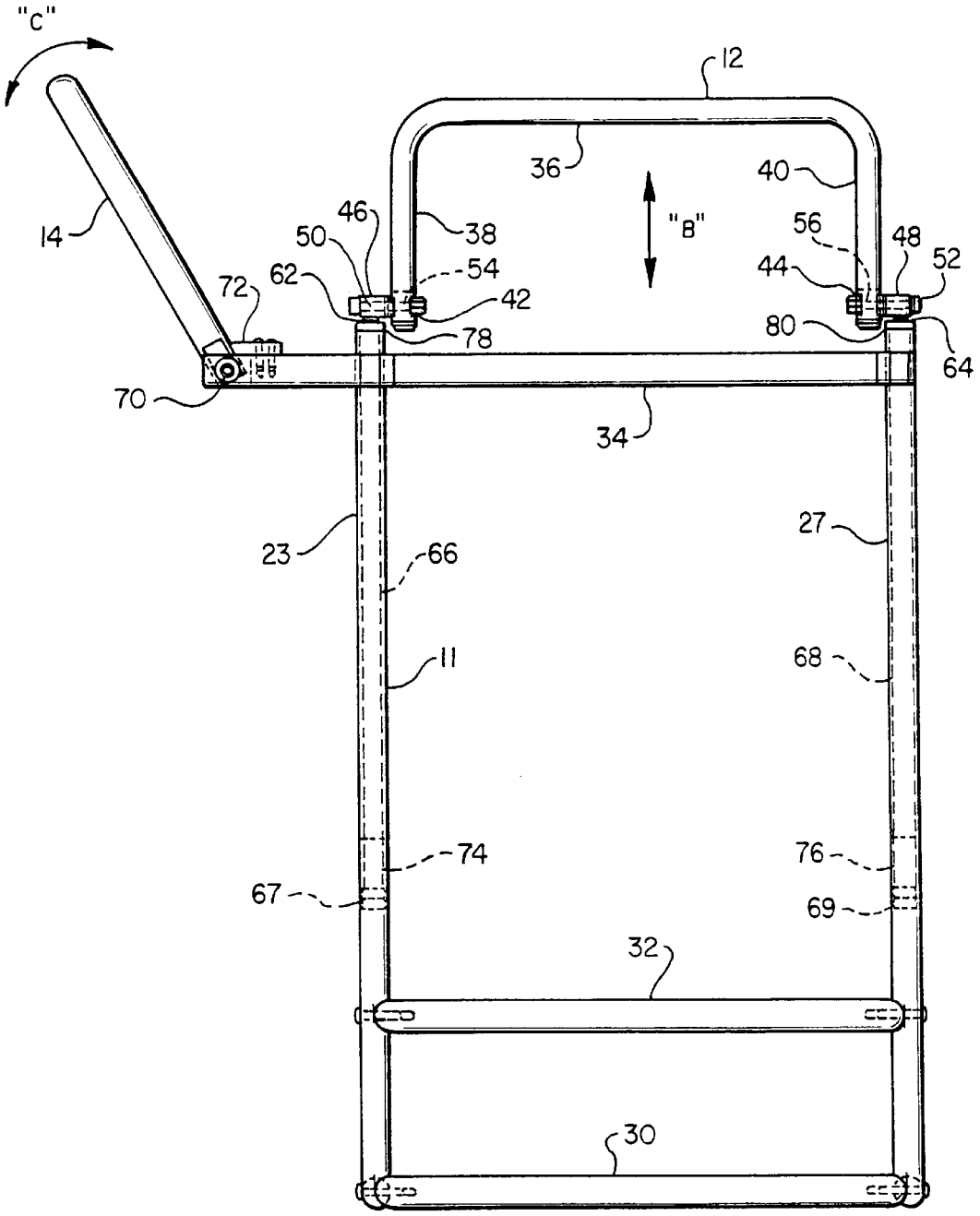
FIG. 3 is a top plan view of the embodiment.

Referring now to FIGS. 3 and 4, the mechanical features of the preferred embodiment supporting the positioning and the use of handle 12 and brace 14 are illustrated. Handle 12 is mounted on co-axial pivoting mounts 42 and 44, which are provided by rods 50 and 52 to position a gripping section 36 within easy reach of a person laying in a bed. Rods 50 and 52 are mounted for rotation in cylinders 46 and 48 with rod exerts 54 and 56 extending from the cylinders to mate with holes through handle arms 38 and 40, respectively. Appropriate threaded nuts or other fastening elements may be used to hold handle 12 on rod exerts 54 and 56.

Extension and retraction of handle 12 relative to frame 11 is supported on piston rods 62 and 64, which extend from the bases of mounting cylinders 46 and 48, respectively, and which are partially inserted into the open ends of positioning arms 23 and 27. Rods 62 and 64 are free to move in and out of positioning arms 23 and 27 except as restrained by retaining nuts 67 and 69, which are attached to the inserted ends of the rods, and by restraining caps 78 and 80. Restraining caps 78 and 80 close the open ends of positioning arms 23 and 27 save for annular openings sized to pass rods 62 and 64. Restraining caps 78 and 80 are of smaller diameter than the width of nuts 67 and 69 and block the passage of springs 66 and 68. This allows the free traversal of the rods 62 and 64, while providing a base against which compression springs 66 and 68 impinge when forced by nuts 67 and 69.

Compression springs 66 and 68 urge rods 62 and 64 to retracted positions in positioning arms 23 and 27 by pressing against nuts 67 and 69 from restraining caps 78 and 80. Springs 66 and 68 are positioned within arms 23 and 27 and are held in place by retaining nuts 67 and 69, affixed to the inserted ends of rods 62 and 64 and restraining caps 78 and 80. If desired, the tension on compression springs 66 and 68 may be adjusted for heavier individuals by inserting tensioning inserts 74 and 76 between the ends of the springs and either the retaining nuts 67 and 69, respectively, or between the springs and the restraining caps 78 and 80 (not shown). Alternatively, an end portion of the piston rods 62 and 64 may be threaded and threaded fasteners such as nuts placed thereon. The fasteners then provide bases for an end of each tensioning spring and can be positioned to adjust spring tension. Sprig 66 and 68 and tensioning inserts 74 and 76 are selected to allow adjustment of the retractive force on handle 12 to be adjusted for the weight or strength of the person who will use the device. For a patient with minimal upper body strength and no abdominal strength, the maximum retractive force, exerted when handle 12 is pulled to the required extension to reach the patient in a prone condition, should fall just short of matching the fully reclined patient's weight on the handle. The patient then should have to do little more than pull him or herself up a few centimeters on the handle 12, reducing the effective weight on the handle to allow spring tension to pull the individual to an upright sitting position as soon as spring force exceeds the patient's applied weight. An electric motor could also be utilized for retracting the handle 12.

Brace 14 is pivotally mounted to an extension of cross member 34, which positions the pivot 70 for the brace at a point horizontally displaced from the upper or positioning section of frame 11 toward an edge of the bed. A pivot stop 72 limits travel of brace 14 toward the center of the bed and allows the infirm user of the apparatus to pull him or herself around to bring their legs over the edge of the bed. Brace 14 may then be pivoted outwardly over the edge of the bed, or to other convenient positions, to provide a support for the individual as he or she stands. It should be apparent that brace 14 and handle 12 may be used to reverse the process as well.

The present invention aids the infirm in getting into and out of bed, generally without assistance of another individual, or in the case where two elderly persons live together, eases the task of getting a mate out of bed. The preferred embodiment is readily installed on most beds, requiring no permanent physical modification of the bed, and is readily removed if desired. When positioned with a bed the apparatus does not limit access to the bed by blocking the major sides with rails.

While the invention is shown in only one of its forms, it is not thus limited but is susceptible to various changes and modifications without departing from the spirit and scope of the invention.

What is claimed is:

1. Apparatus for assisting persons getting into and out of bed, comprising:

a handle;

a frame for supporting the handle above a bed;

a base section connected to the frame for supporting the frame from a location off an upper major surface of a bed mattress, the frame extending upwardly from the base section around an end edge of the bed mattress leaving side edges of the mattress open to unobstructed access;

an extensible linkage attaching the handle to the frame; and means for biasing the extensible linkage toward a retracted position on the frame and oriented to assist pulling a recumbent person grasping the handle to a sitting position.

2. Apparatus as claimed in claim 1, wherein the frame comprises:

a projection section extending from the base section to a point over the upper major surface; and the extensible linkage being mounted to the projection section to place the handle within easy reach of a person recumbent on the upper major surface of the mattress.

3. Apparatus as claimed in claim 2, wherein the handle is pivotally mounted to the extensible linkage for rotation on an axis parallel to the upper major surface of the mattress and transverse to the direction of elongation thereof.

4. Apparatus as claimed in claim 3, and further comprising:

a support handle depending from the frame giving a person lateral support for standing up from the bed or sitting down on the bed.

5. Apparatus as claimed in claim 4, the extensible linkage further comprising:

first and second piston rods for insertion into the projection section of the frame; and retainers for locking the piston rods onto the frame.

6. Apparatus as claimed in claim 5, wherein the means for biasing further comprises:

first and second springs for the first and second piston rods positioned to be compressed by withdrawal of the handle from the frame to compress the springs against the retainers; and spring tension adjusting inserts for tensioning the springs to provide enough retraction force to balance the weight of the person using the apparatus.

7. A patient self-assist transfer aid for use with a bed, comprising:

an open box frame having a base for fitting beneath a mattress of a bed, a riser section extending upwardly from the base for extending around an edge of the mattress and a positioning section for extending out over the mattress from the riser section, the open box frame being positionable with respect to the bed for leaving access to the bed open along the major elongated edges of the bed;

a linkage fitted to the positioning section of the open box frame and extendable therefrom;

a spring bias element coupled between the linkage and the positioning section urging movement of the linkage to a retracted position; and a handle attached to the linkage and positioned by the positioning section to be reachable by a patient recumbent in the bed.

8. A patient self-assist transfer aid as claimed in claim 7, wherein the spring bias element is tuned to generate sufficient retractive force on the handle to help lift the person grasping it from a near recumbent to a sitting position.

9. A patient self-assist transfer aid as claimed in claim 8, further comprising:

a pivotable brace depending from an outside edge of the positioning section of the open box frame to provide support to a patient sitting on the bed in moving to a standing position alongside the bed.

10. A patient self-assist transfer aid as claimed in claim 9, further comprising:

means for adjusting the tension of the spring biasing element to compensate for the weight or upper body strength of a patient commonly using the aid.

11. An apparatus for supporting and aiding lifting of a person during movement between recumbent and sitting positions and during movement between sitting and standing positions relative to a bed, the apparatus comprising:

first and second horizontally spaced, generally U-shaped tubular members;

interconnecting elements connected between the U-shaped tubular members bracing the members on one another;

each of the U-shaped tubular members having lower portions laying in substantially the same plane for fitting between a mattress of a bed and a supporting foundation for the mattress;

each of the U-shaped tubular members having substantially coplaner upper sections with open ends;

first and second piston rods, each of which is partially inserted into the open end of an upper section and extensible therefrom;

a handle coupled to the uninserted ends of the piston rods; and first and second springs acting on the first and second piston rods for urging their retraction into the upper sections.

12. An apparatus for supporting and aiding lifting of a person as set forth in claim 11, the apparatus further comprising:

a horizontally pivotable support brace attached to an upper section.

13. An apparatus for supporting and aiding lifting of a person as set forth in claim 12, wherein the handle is vertically rotatable.

14. An apparatus for supporting and aiding lifting of a person as set forth in claim 13, the apparatus further comprising:

first and second spring displacement inserts for adjusting spring tension for the upper body weight or upper body strength of a particular person.

* * * * *